US006741150B2

(12) United States Patent
Holmes et al.

(10) Patent No.: US 6,741,150 B2
(45) Date of Patent: May 25, 2004

(54) WINE GLASS CHARM

(75) Inventors: Lisa Henry Holmes, Paradise Valley, AZ (US); Holly K. Ostlund, Scottsdale, AZ (US); Chrissa M. Wurm, Mesa, AZ (US)

(73) Assignee: Who! International Designs, LLC, Scottsdale, AZ (US)

( * ) Notice: Subject to any disclaimer, the term of this patent is extended or adjusted under 35 U.S.C. 154(b) by 52 days.

(21) Appl. No.: 10/106,921

(22) Filed: Mar. 25, 2002

(65) Prior Publication Data

US 2003/0179059 A1 Sep. 25, 2003

(51) Int. Cl.[7] ..... H01H 9/00

(52) U.S. Cl. ..... 335/207; 335/302; 63/3; 24/303

(58) Field of Search ..... 335/207–205, 335/302–306; 40/307–310, 633.5–659; 292/307 R; 63/3; 24/303

(56) References Cited

U.S. PATENT DOCUMENTS

| | | | | |
|---|---|---|---|---|
| 3,129,477 A | * | 4/1964 | Mizuno | 292/307 R |
| 6,247,334 B1 | * | 6/2001 | Visser | 63/3 |
| 6,293,034 B1 | | 9/2001 | Skapyak et al. | 40/310 |

OTHER PUBLICATIONS

Quest Beads & Cast, Inc., "Quest Beads Supply and Design House for All Your Creative Needs", 1999/2000, front page, inside front page and back page, no month.

* cited by examiner

*Primary Examiner*—Lincoln Donovan
(74) *Attorney, Agent, or Firm*—Cahill, Sutton & Thomas P.L.C.

(57) ABSTRACT

A wine glass charm includes a magnetic coupling, the components of which are disposed at the respective ends of an encircling member to detachably attach the wine glass charm to the stem or handle of a drinking vessel. The encircling member may include identifying indicia or media and for further identification purposes, a uniquely configured charm may be dependingly supported therefrom.

16 Claims, 1 Drawing Sheet

WINE GLASS CHARM

BACKGROUND OF THE INVENTION

1. Field of the Invention

The present invention relates to identification bracelets and, more particularly, to identifying media for use in conjunction with various types of drinking vessels.

2. Description of Related Art

At most social gatherings, the participants are served liquid refreshments served in non-throw away vessels, such as wine glasses, beer steins, etc. During the course of such a gathering, the participants often seek to obtain refills but sometimes forget where they may have left their original drinking vessel and seek a replacement. This results in numerous empty or partially filled drinking vessels distributed throughout the area of the gathering. More importantly, the participants seeking refills tend to request or obtain clean and unused drinking vessels. This demand for substitute drinking vessels places a heavy burden on the host or hosting organization to have a supply of drinking vessels far greater in number than the number of participants at the gathering.

Many times participants at a gathering inadvertently pick up a drinking vessel believing it to be their own and end up drinking out of a drinking vessel previously used by someone else. This leads to socially awkward situations. Moreover, the drinking vessels may become transmitting media for bacteria and viruses with resulting medically related complications. In many cases, severe emotional stress is created when a person realizes he/she has been drinking out of someone else's drinking vessel.

One solution to this problem is that of using only throw away drinking vessels but this solution is essentially only socially practical and acceptable at outdoor gatherings of an informal nature. For primarily indoor gatherings, wherein stemware and/or beer steins having handles are the drinking vessels of choice, personal identifying media has been used. One such media is the use of paper roundels normally used as coasters that have been cut from the perimeter to the center to permit insertion of the stem of a wine glass and the cut is closed by length of adhesive tape. The user can then write his/her name on the paper roundel for identifying purposes. Identifying media of this type is relatively inexpensive and serves it's purpose but it requires preparation and care during use, which are impediments to the practical value of this media.

To reduce the workload and yet provide an identifying media, differently configured charms mounted on or depending from a wire clasp has been used. Such a clasp includes a U-shaped ends or hooks to permit mounting the clasp about the stem of a wine glass or handle of a beer stein and engaging the hooks with one another. For some people such engagement requires two-handed manipulation and depending upon the dexterity of a user, more or less difficulty is encountered.

SUMMARY OF THE INVENTION

The present invention includes an unique encircling member that may be a string of beads, a wire or one or more strands and may support an identifying charm. The opposed ends of the encircling member support magnets of opposing polarity when facing one another to form a magnetic coupling. To detachably attach the encircling member to the stem of a wine glass, handle of a beer stein or similar element of a drinking vessel, the ends of the encircling member are placed thereabout and into close proximity with one another. Upon placement in close proximity with one another, the end supported magnets are attracted to one another and become magnetically coupled. Thereby, the user has identified his/her drinking vessel as the encircling member with or without a supported charm(s) is unique from those of others. When the need for identification ceases, disengagement is effected by simply pulling the magnetically coupled ends apart from one another and withdrawing the encircling member from about the element.

It is therefore a primary object of the present invention to provide identifying media for use in conjunction with drinking vessels.

Another object of the present invention is to provide a magnetically coupled identifying media for engaging the stem or handle of a drinking vessel.

Yet another object of the present invention is to provide an identifying charm magnetically coupled about the stem of a wine glass or handle of a mug or cup.

Still another object of the present invention is to provide a magnetic coupling for retaining a string of beads or the like about the stem of a wine glass or the handle of a cup or mug.

A further object of the present invention is to provide a flexible element having magnetically coupled ends for encircling the stem of a wine glass or the handle of a cup or mug.

A yet further object of the present invention is to provide a wine glass charm retained in place by a magnetic coupling.

A still further object of the present invention is to provide a magnetically detachably attachable identifying media for use with drinking vessels.

A still further object of the present invention is to provide a method for identifying a drinking vessel used by a particular user.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
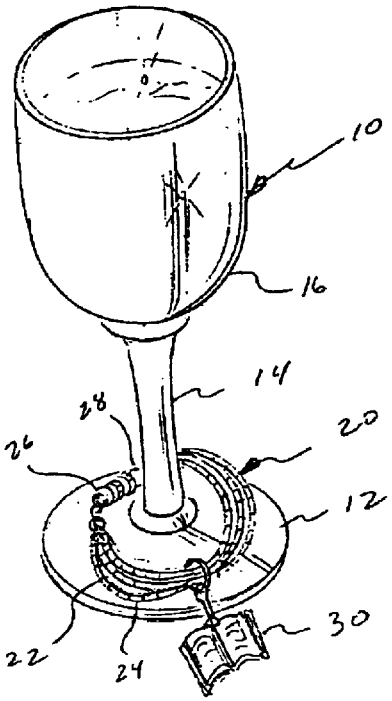
FIG. 1 illustrates a representative wine glass having a magnetically coupled identifying media encircling the stem.

Referring to FIG. 1, there is illustrated a representative wine glass 10 having a base 12 from which extends a stem 14 supporting a glass bowl 16. A user identifying media 20, hereinafter sometimes referred to generically as a wine glass charm, is disposed about stem 14 and rests upon base 12. The wine glass charm includes an encircling member 22 encircling stem 14. It may be of various configurations and preferably is of one or more strands of beads 24, as illustrated. Ends 26, 28 of the encircling member are magnetically coupled with one another to retain the encircling member about stem 14.

The shape, configuration, color, etc., of encircling member 22 may be considered as the identifying criteria to uniquely associate the encircled wine glass with a particular user. Alternatively or in conjunction therewith, a charm 30, such as the illustrated depiction of an opened book, may be suspended from encircling member 22. In such event, the unique charm would serve the function of the user identifying criteria.

Figure 2:
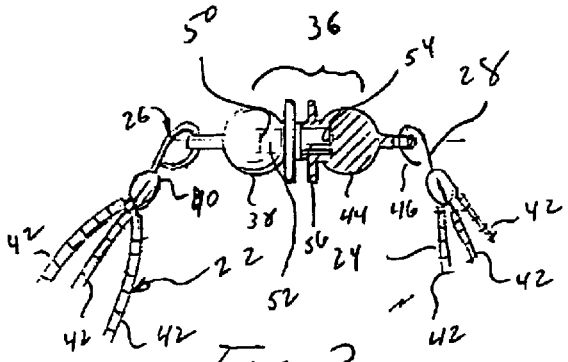
FIG. 2 is a partial cross sectional view of the magnetic coupling elements.
Figure 3:
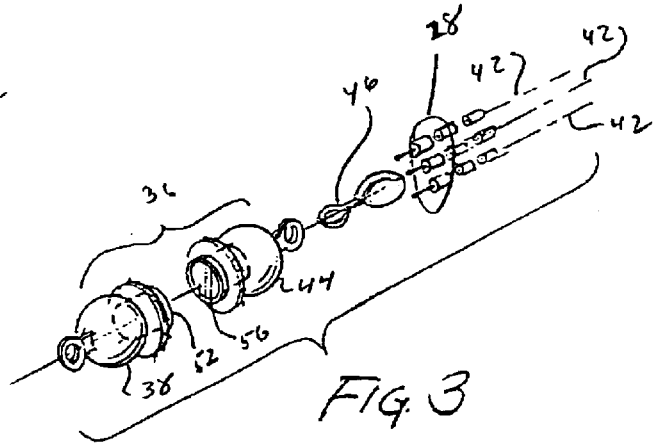
FIG. 3 is an exploded view of the magnetic coupling elements.

Magnetic coupling 36 is disposed between ends 26, 28 of encircling member 22, as illustrated in FIGS. 2 and 3. Magnetic coupling 36 includes a keeper 38 secured to a clasp 40 disposed at end 26. One or more strands 42 of beads 24, or the like, extend from clasp 40. A further keeper 44 is attached to encircling member 22 through a further clasp 46 disposed at end 28 of one or more strands 42 of beads 24. Keeper 38 includes a cavity 50 for retainingly receiving a magnet 52. Similarly, keeper 44 includes a cavity 54 for retainingly receiving a magnet 56. The orientation of magnets 52 and 56 is maintained to provide an attracting magnetic force therebetween to retain keepers 38, 44 magnetically detachably attached to one another when placed adjacent one another, as shown in FIG. 2. Thereby, upon encircling stem 14 (see FIG. 1) with encircling member 22 to bring keepers 38, 44 in proximity with one another, the attracting magnetic forces between magnets 52, 56 will join with one another to form magnetic coupling 36 and retain wine glass charm 20 in place about the stem of the wine glass.

It is to be understood that the magnet coupling can also be established with only one magnet. In such event the keeper not containing/embodying a magnet would be of magnetically responsive material (such as a ferrous product) to create a magnetic attraction between the keeper embodying the magnet and the keeper devoid of a magnet.

Figure 4:
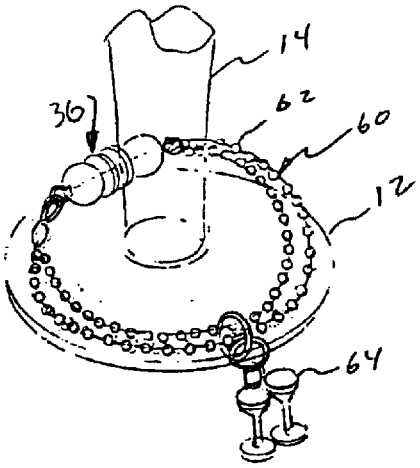
FIG. 4 illustrates a variant of the identifying media shown in FIG. 1.

FIG. 4 illustrates a variant 60 of encircling member 22 having a pair of strands supporting beads 62, differently configured from those shown in FIGS. 2, 3, or other threadedly mounted elements. Moreover, a charm 64 representative a pair of a wine glasses is supported by variant 60 to provide unique identification to the user of the associated wine glass. As depicted, variant 60 includes a magnetic coupling 36 for detachably attaching the variant.

Figure 5:
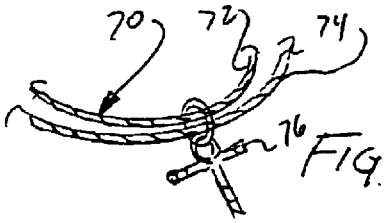
FIG. 5 illustrates a further variant of the identifying media shown in FIGS. 1 and 4.

FIG. 5 illustrates a further variant 70 of encircling member 22 shown in FIG. 1. Herein, the encircling member may be one or more strands of material, of which two strands 72, 74 are illustrated. These strands may be of metallic or non-metallic material; preferably, they are of non resilient flexible material. A yet further charm 76, depicting a cross, may be used as an identifying symbol for the user of the wine glass about which stem variant 70 is mounted.

Figure 6:
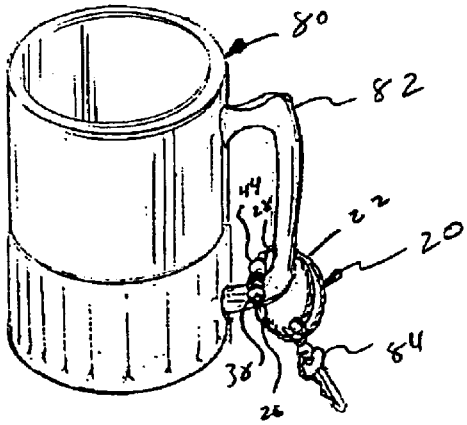
FIG. 6 illustrates the identifying media used in conjunction with the handle of a cup, mug or beer stein.

Sometimes beer steins, mugs or cups having handles are used in place of or in conjunction with wine glasses at business or social gatherings. As with wine glasses, it is generally of concern to insure that a user be able to identify the beer stein, mug or cup which he/she has been using. FIG. 6 illustrates a representative beer stein, mug or cup identified by reference numeral 80 and having a handle 82. The handle is uniquely adapted for engagement by user identifying media 20 described above. A user would encircle a part of the handle with encircling member 22 until keeper 38 at end 26 becomes magnetically coupled with keeper 44 at end 28. The resulting detachable attachment of the user identifying media would provide a source of identification of the user associated with the particular beer stein, mug or cup. To further enhance the identification by a user, a charm 84 may be dependingly supported from encircling member 22, which charm is illustrated as a key.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A wine glass charm, said wine glass charm comprising in combination:

a) an encircling member of non resilient flexible material having a pair of ends and adapted to encircle an element of a drinking vessel;

b) at least one charm supported by said encircling member;

c) a coupling for detachably attaching said pair of ends with one another;

d) said coupling including a first keeper disposed at one end of said pair of ends and a second keeper disposed at the other end of said pair of ends; and e) said coupling further including a first magnet, a said first keeper being adapted for supporting said first magnet, and a second magnet, said second keeper being adapted for supporting said second magnet, said first and second magnets being oriented to provide a magnetic attraction force therebetween.

2. A wine glass charm as set forth in claim 1 wherein said first keeper includes a cavity for retainingly receiving said first magnet and wherein said second keeper includes a cavity for retainingly receiving said second magnet.

3. A wine glass charm as set forth in claim 2 wherein said first and second magnets are cylindrical.

4. A wine glass charm as set forth in claim 1 wherein said encircling member includes a plurality of strands.

5. A wine glass charm as set forth in claim 4 wherein said strands are strands of beads.

6. A user identifying media for use with a drinking vessel, said media comprising in combination:

a) an encircling member of non resilient flexible material having a pair of ends adapted for encircling an element of the drinking vessel, said encircling member including identifiable indicia; and b) a magnetic coupling for detachably attaching said pair of ends to one another to retain said indicia about the element.

7. A user identifying media as set forth in claim 6 wherein said magnetic coupling includes a first magnet secured to a first end of said pair of ends and a second magnet secured to a second end of said pair of ends.

8. A user identifying media as set forth in claim 6 wherein said identifiable indicia includes a charm supported by said encircling member.

9. A user identifying media as set forth in claim 6 wherein said encircling member includes a plurality of strands.

10. A user identifying media as set forth in claim 9 including a charm supported by said plurality of strands.

11. A user identifying media as set forth in claim 9 wherein said plurality of strands are strands of beads.

12. A user identifying media as set forth in claim 7 wherein said first and second magnets are disposed in cavities formed in respective ones of said first and second ends.

13. A method for adding a user identifying media to an element of a drinking vessel, said method comprising the steps of:

a) encircling the element of the drinking vessel with an encircling member of non resilient flexible material having opposed ends; and b) joining and retaining joined the opposed ends of the encircling member with a magnetic coupling.

14. The method as set forth in claim 13 wherein said steps of joining and retaining joined are carried out by a magnet disposed in at least one end of the opposed ends.

15. The method as set forth in claim 13 including the step of suspending a charm from the encircling member.

16. The method as set forth in claim 14 wherein said steps of joining and retaining joined are carried out by a magnet disposed in each end of the opposed ends.

* * * * *